US006104904A

United States Patent [19]

Snelling

[11] Patent Number: 6,104,904

[45] Date of Patent: Aug. 15, 2000

[54] REPRODUCTION MACHINE INCLUDING A PNEUMATICALLY COUPLED SONIC TONER RELEASE DEVELOPMENT APPARATUS

[75] Inventor: Christopher Snelling, East Rochester, N.Y.

[73] Assignee: Xerox Corporation, Stamford, Conn.

[21] Appl. No.: 09/411,211

[22] Filed: Oct. 4, 1999

[51] Int. Cl.[7] ..... G03G 15/08

[52] U.S. Cl. ..... 399/265; 399/266

[58] Field of Search ..... 399/265, 266, 399/290, 291, 292, 293

[56] References Cited

U.S. PATENT DOCUMENTS

| | | | |
|---|---|---|---|
| 4,546,722 | 10/1985 | Toda et al. | 118/657 |
| 4,568,955 | 2/1986 | Hosoya et al. | 346/153.1 |
| 4,647,179 | 3/1987 | Schmidlin | 355/3 DD |
| 4,833,503 | 5/1989 | Snelling | 355/259 |
| 4,868,600 | 9/1989 | Hays et al. | 359/259 |
| 4,987,456 | 1/1991 | Snelling et al. | 355/273 |
| 5,010,367 | 4/1991 | Hays | 355/247 |
| 5,255,059 | 10/1993 | Kai et al. | 355/261 |
| 5,339,142 | 8/1994 | Hays | 355/259 |
| 5,523,827 | 6/1996 | Snelling et al. | 355/259 |
| 5,754,930 | 5/1998 | Stark et al. | 399/290 |
| 5,809,385 | 9/1998 | Snelling et al. | 399/266 |

*Primary Examiner*—Joan Pendegrass
*Attorney, Agent, or Firm*—Tallam I. Nguti

[57] ABSTRACT

A pneumatically coupled sonic toner release development apparatus is provided for reliably and uniformly developing latent electrostatic images in a toner image reproduction machine using charged toner particles. The pneumatically coupled sonic toner release development apparatus includes a development housing defining a sump for holding developer material containing the charged toner particles; a developer material moving device mounted within the sump for transporting developer material within the sump; and a pneumatically coupled sonic toner release assembly including an acoustic transducer, a pneumatic coupling device connected to the acoustic transducer, and a pneumatic donor assembly connected to the pneumatic coupling device. The pneumatic donor assembly is mounted partially within the sump for receiving charged toner particles from the developer material moving device and for transporting the charged toner particles through a development nip of a reproduction machine for high quality image development. The acoustic transducer and pneumatic coupling device produce uniform acoustic motions in the pneumatic donor assembly for uniformly releasing charged toner particles from the pneumatic donor assembly, thereby resulting in high quality toner image development.

11 Claims, 2 Drawing Sheets

REPRODUCTION MACHINE INCLUDING A PNEUMATICALLY COUPLED SONIC TONER RELEASE DEVELOPMENT APPARATUS

BACKGROUND OF THE INVENTION

The present invention relates to electrostatographic reproduction machines, and more particularly to such a machine including a pneumatically coupled sonic toner release development apparatus for improving reliability, as well as uniformity of non-interactive development acoustic motions, and of the resulting toner development.

The present invention can be utilized in the art of xerography or in the printing arts. In the practice of conventional xerography, it is the general procedure to form electrostatic latent images on an image bearing surface of a uniformly charged photoreceptor. The charge on the surface is selectively dissipated in accordance with an image-wise pattern of activating radiation corresponding to original images. The selective dissipation of the charge leaves a latent pattern of charged and discharged or charge dissipated areas on the imaging surface. In what is referred to as a Charged Area Development (CAD) environment, the discharged or charge dissipated areas on the photoreceptor correspond to residual or background voltage levels, and the still charged areas correspond to image areas. In what is referred to as a Discharged Area Development (DAD) environment, the discharged or charge dissipated areas on the photoreceptor correspond to residual or background voltage levels, and the discharged areas correspond to image areas.

In either environment, the image areas are then developed or rendered visible with charged toner particles. The charged toner particles generally comprise a colored powder whose particles adhere to the charge pattern on the image bearing surface, thus forming a toner developed image. The toner developed image is then first transferred to a receiving substrate, such as plain paper, to which it is then heated and fixed by any suitable fusing technique.

Conventional xerographic imaging techniques which were initially limited to monochrome image formation have been extended to the creation of color images, including process as well as highlight multicolor images. In either case, particularly in single pass multicolor image process machines and highlight color machines, toner developed images from an upstream development unit of the machine must be moved through the development fields of a downstream development unit. Scavenging or undesirable removal of some of the toner particles from the previously developed image, usually resulting in a less than desired quality final image, is ordinarily a problem in such multicolor machines.

Pneumatically coupled sonic toner release development techniques and apparatus have been proposed for use in such multicolor image machines in order to reduce such scavenging, as well as, interaction between the previously developed image and the downstream development fields, in order to improve the developed image quality. Such donor-development or pneumatically coupled sonic toner release development techniques include conventional prior art development electrode types, for example, the exposed development electrode wire technique, and the embedded development electrode techniques, examples of which will be described below. Such pneumatically coupled sonic toner release development techniques also include conventional vibratory or electrostatic techniques, for example, that using sonic toner release, that using a piezo-active donor roll, and that using an electrostatic transducer, examples of which will also be described below.

Following then is a discussion of examples of such prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,523,827 entitled Piezo Active Donor Roll (PAR) For Store Development, issued Jun. 4, 1996, to Snelling et al., discloses a vibratory type development system which uses a donor roll structure including a piezoelectric layer for liberating toner particles from its surface. The donor roll is provided with a plurality of electrodes spaced about the circumference of the roll. An AC voltage is applied to the electrodes as they pass through a developer nip or zone intermediate the donor roll and an imaging member containing latent electrostatic images. The voltage is applied to each electrode and another continuous electrode which together sandwich the piezoelectric layer therebetween such that an AC voltage is applied across a portion of the piezoelectric layer in the nip thereby causing electrostatic excitation of the portion of the layer only in the nip.

U.S. Pat. No. 5,339,142 entitled AC/DC Spatially Programmable Donor Roll For Xerographic Development and issued Aug. 16, 1994, to Hays, discloses a development electrode type non-interactive development system for use in color imaging. To control the developability of lines and the degree of interaction between the toner and receiver, an AC voltage is applied between a donor roll and electrodes supported adjacent to the surface of the donor roll to enable efficient detachment of toner from the donor to form a toner cloud. An AC voltage applied between the donor assembly and an image receiver serves to position the cloud in close proximity to the image receiver for optimum development of lines and solid areas without scavenging a previously toned image.

U.S. Pat. No. 4,546,722 granted on Oct. 15, 1985, to Toda et al discloses a vibratory or electrostatic type development apparatus having a toner carrying member and a piezoelectric vibrator for displacing toner from the toner carrying member and causing it to fly in a manner to avoid depositing toner onto a non-image area of an image bearing surface. Such an arrangement prevents degradation of the charged image for the purpose of image preservation. Toner release control and adverse, image degradation influences are still likely, given the magnitude of the electrostatic fields.

U.S. Pat. No. 4,987,456 granted to Snelling et al., on Jan. 22, 1991, is directed to a conventional vibratory or electrostatic type apparatus in which a resonator suitable for generating vibratory energy is arranged in line mechanical contact with the back side of a charge retentive member bearing an image on a surface thereof, in an electrophotographic device, to uniformly apply vibratory energy to the charge retentive member. The resonator comprises a vacuum producing element, a vibrating member, and a seal arrangement. Where the vibratory energy is to be applied to the charge retentive surface, a vacuum is applied by the vacuum producing element to draw the surface into intimate engagement with the vibrating member, and edge seal arrangement. The invention has application to a transfer station for enhancing electrostatic transfer of toner from the charge retentive surface to a copy sheet, and to a cleaning station, where mechanical vibration of the surface will improve the release of residual toner remaining after transfer.

U.S. Pat. No. 5,255,059 granted on Oct. 19, 1993, to Kai et al., discloses a vibratory or electrostatic type image forming apparatus incorporating a stationary, hollow cylindrical donor structure including a single set of electrodes within its hollow, and a piezoelectric layer formed over the electrodes. The donor structure may be in the form of a roll or a belt. In each embodiment disclosed, a phase shifted voltage is applied to the electrodes for the purpose of creating a waving action which is effective to transport toner particles from a sump to a development zone. Thus, while the toner is moved through electrostatic action alone of the waving materials, the donor structure itself is stationary.

U.S. Pat. No. 4,568,955 issued on Feb. 4, 1986, to Hosoya et al., discloses a development electrode type recording apparatus wherein a visible image based on image information is formed on an ordinary sheet by a developer. The recording apparatus comprises a donor roller spaced at a predetermined distance from and facing the ordinary sheet and carrying the developer thereon, a recording electrode and a signal source connected thereto for propelling the developer on the developing roller to the ordinary sheet by generating an electric field between the ordinary sheet and the developing roller according to the image information, and a plurality of mutually insulated electrodes provided on the developing roller and extending therefrom in one direction. An AC and a DC source are connected to the electrodes, for generating an alternating electric field between adjacent ones of the electrodes to alone cause oscillations of the developer found between the adjacent electrodes along electric lines of force therebetween to thereby liberate the developer from the developing roller, and to thereby form the toner particles into smoke in the vicinity of the donor roller and the sheet.

U.S. Pat. No. 5,010,367 granted to Hays on Apr. 23, 1991, relates to a development electrode type non-interactive development system for use in color imaging. To control the developability of lines and the degree of interaction between the toner and receiver, an AC voltage alone is applied between a donor roll and electrodes supported adjacent to the surface of the donor roll to enable detachment of toner from the donor to form a toner cloud. An AC voltage applied between the donor assembly and an image receiver serves to position the cloud in close proximity to the image receiver for optimum development of lines and solid areas without scavenging a previously toned image.

U.S. Pat. No. 4,833,503 granted to Snelling on May 23, 1989, is directed to a multi-color printer using a conventional vibratory or electrostatic type apparatus. In it, vibratory energy only is provided by a sonic toner release development system in an attempt to develop either partial or full color images with minimal degradation by subsequent over-development.

U.S. Pat. No. 4,647,179 issued Mar. 3, 1987, to Schmidlin, discloses a development electrode type development apparatus including only a traveling electrostatic AC wave conveyor for transporting toner particles from a development housing to an imaging surface. The traveling electrostatic AC wave conveyor comprises a linear array of spaced apart conductive electrodes and a phase shifted multiphase AC voltage source connected to the electrodes for creating the wave.

U.S. Pat. No. 4,868,600 issued Sep. 19, 1989, to Wayman et al., discloses a development electrode type development apparatus in which AC electric fields alone are applied to self-spaced electrodes positioned within a development nip. The electrodes are mounted at their ends to bearing blocks, and are self-spaced from the donor member by toner particles.

Non-interactive vibratory or electrostatic type development units, (as disclosed in any of the relevant example references above), typically each utilizes vibratory energy alone to effect toner particle release from the development nip side of the donor member by mechanically reducing toner particle adhesion forces on the donor member. The vibratory energy alone therefore must be of a level high enough to effect such toner release, and additionally enable toner particle travel for image development across an air gap in the development nip within a D. C. electrostatic field. A lack of uniformity of vibratory motion in the development nip necessary over the full length of the donor roll to accelerate the toner particles to release from the donor member is an issue for these devices.

Nonetheless, Sonic toner release (STORE) development, as disclosed for example in U.S. Pat. No. 4,833,503 (cited above), advantageously occurs advantageously at electric field magnitudes well below those at which air breakdown and other image noise generation effects occur. However, such (STORE) development has so far depended primarily upon application of either piezoelectric polymer film donors or passive donors acoustically activated by mechanical coupling to the tip of an acoustic waveguide. Thus the primary approach has been mechanical coupling of acoustic waveguides to passive donor members.

Unfortunately, development uniformity as pointed out above is an issue in such development processes due to use of mechanical coupling. This is because the operating space for the development process is near to the threshold for toner release from the donor. Acoustic Transfer Assist (ATA) toner release development, on the other hand, operates at relatively high values of electric field which undesirably tend to reduce sensitivity of the (ATA) process to non-uniformities in the magnitude of acoustic motions. Non-uniformities and variations in mechanical coupling between waveguide tip and donor member surface are believed to occur due to wear, dirt and debris build up, and non-uniformities in tension holding the donor member in contact with the waveguide tips. Additionally, mechanical coupling also results in non-uniformities due to inherent waveguide tip motions.

SUMMARY OF THE INVENTION

In accordance with the present invention, there is provided a pneumatically coupled sonic toner release development apparatus for reliably and uniformly developing latent electrostatic images in a toner image reproduction machine using charged toner particles. The pneumatically coupled sonic toner release development apparatus includes a development housing defining a sump for holding developer material containing the charged toner particles; a developer material moving device mounted within the sump for transporting developer material within the sump; and a pneumatically coupled sonic toner release assembly including an acoustic transducer, a pneumatic coupling device connected to the acoustic transducer, and a pneumatic donor assembly connected to the pneumatic coupling device. The pneumatic donor assembly is mounted partially within the sump for receiving charged toner particles from the developer material moving device and for transporting the charged toner particles through a development nip of a reproduction machine for high quality image development. The acoustic transducer and pneumatic coupling device are suitable for producing uniform acoustic motions in the pneumatic donor assembly so as to uniformly release charged toner particles from the pneumatic donor assembly, thereby resulting in high quality toner image development.

DESCRIPTION OF THE DRAWINGS

In the detailed description of the invention presented below, reference will be made to the drawings, in which.

DETAILED DESCRIPTION OF THE INVENTION

This invention relates to an imaging or reproduction system which is used to produce a multi-color output image. It will be understood that it is not intended to limit the invention to the embodiment disclosed. On the contrary, it is intended to cover all alternatives, modifications and equivalents as may be included within the spirit and scope of the invention as defined by the appended claims.

Figure 1:
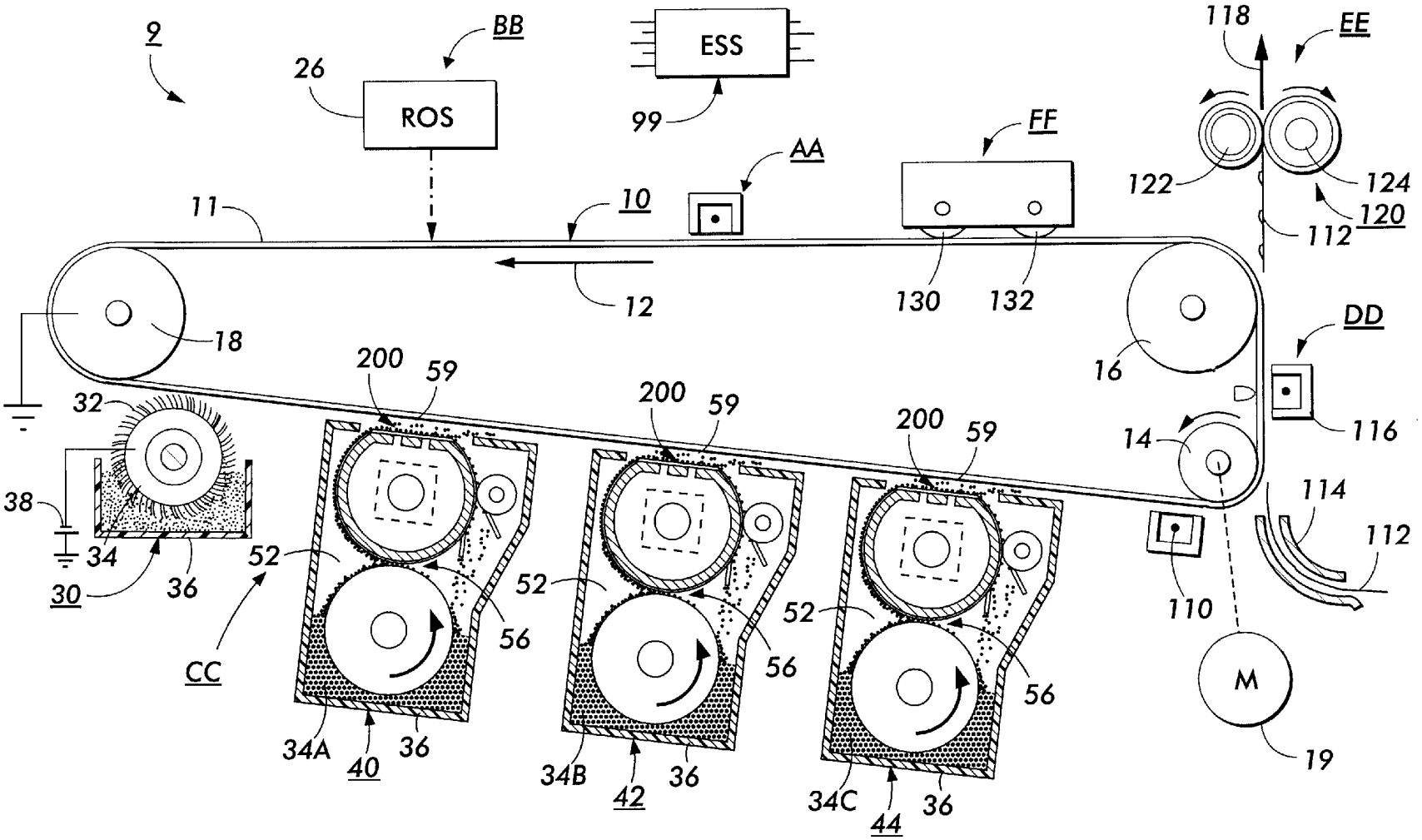
FIG. 1 is a schematic illustration of an exemplary multi-color image reproduction machine including a pneumatically coupled sonic toner release development apparatus in accordance with the present invention.

FIG. 1 schematically depicts the various components of an illustrative electrophotographic reproduction machine 9 that incorporates the pneumatically coupled sonic toner release development apparatus of the present invention. As shown in FIG. 1, the electrostatographic reproduction machine 9, includes a monopolar photoreceptor belt 10 having a photoconductive surface 11 that is formed on a conductive substrate. Belt 10 moves in the direction indicated by arrow 12, advancing sequentially through various types of xerographic process stations, as are well known. The belt is entrained about a drive roller 14 and two tension rollers 16 and 18. The roller 14 is operatively connected to a drive motor 19 for effecting movement of the photoreceptor belt 10 in an endless path.

With continued reference to FIG. 1, a portion of belt 10 passes through charging station AA where a corona generating device, indicated generally by the reference numeral 22, charges the photoconductive surface 11 of belt 10 to a relative high, and substantially uniform, negative potential, for example.

Next, the uniformly charged portions of the surface 11 are advanced through exposure station BB. At exposure station BB, the uniformly charged photoreceptor or charge retentive surface 11 is exposed to a laser Raster Output Scanner (ROS) device 26 which causes the charge retentive surface 11 to be discharged in some areas in accordance with the output from the scanning device. Although the ROS device could be replaced by a conventional xerographic exposure device, preferably the ROS device 26 is a three level device suitable for performing tri-level latent imaging.

Tri-level latent imaging for highlight color xerography is described, for example, in U.S. Pat. No. 4,078,929 issued in the name of Gundlach, (and incorporated herein by reference). Tri-level xerography is used typically as a means for achieving single-pass highlight color imaging. In highlight color imaging achieved thus, xerographic contrast on the charge retentive surface 11 of the photoreceptor is divided into three levels, rather than into two levels, as is the case in conventional xerography.

In tri-level imaging, the charge retentive surface 11 of the photoreceptor is initially charged to a voltage $V_0$, which is typically larger in magnitude than −900 volts, but which after undergoing some dark decay, is reduced to a stable photoreceptor voltage $V_{ddp}$ of about −900 volts. The surface 11 is then exposed image-wise such that one image, corresponding to charged image areas (which are subsequently developed using charged-area development, (CAD) techniques, stays at the full photoreceptor potential of $V_{CAD}$ equal to $V_{ddp}$).

To form the other or second image, the surface 11 is also exposed so as to discharge the photoreceptor to a residual potential, $V_{DAD}$ equal to $V_C$ which is typically about −100 volts. The other or second image thus corresponds to areas discharged to the residual potential, and which are subsequently developed using discharged-area development (DAD) techniques. To form the background areas (the third level), the surface 11 is next also exposed so as to reduce the photoreceptor potential in such background areas to a level $V_{white}$ or $V_w$ (typically −500 volts), which is halfway between the $V_{CAD}$ and $V_{DAD}$ potentials. Following such tri-level latent image formation, the surface 11 is advanced to the development station CC.

At development station CC, a plurality of development units are provided, and include a magnetic brush development unit, and several units of the pneumatically coupled sonic toner release development apparatus of the present invention (to be described in detail below). For developing the first latent CAD image at $V_{CAD}$, at the development station CC, a magnetic brush development unit, indicated generally by the reference numeral 30, is provided for advancing developer material 34 into contact with the CAD electrostatic latent images on the surface 11. As shown, the development unit 30 comprises at least a magnetic brush 32, and a supply of two-component developer material 34 contained in a developer housing 36. The two-component developer material 34 comprises a mixture of carrier beads and black toner particles, along with additives as needed for specific applications.

For the negatively charged, CAD image development, the black toner particles are positively charged. As shown, a suitable negative developer bias is applied to the developer unit 30 from a DC power source 38. The CAD development unit 30 is typically biased about 100 volts closer to $V_{CAD}$ than $V_{white}$ (therefore at about −600 volts).

Magnetic brush development as provided by the unit 30 is an interactive unit, with the developer unit directly interacting with the image being developed. However, it is suitable for developing the CAD images because it is the first development unit in a multiple development unit, single pass process machine. As such, toner developed images do not have to be moved through and past its development fields, and hence there is no risk of scavenging and image degradation from its fields. There are however such risks with respect to the other multiple development units mounted downstream of the unit 30 in such a machine, particularly as here, for developing the discharged area development, or DAD, images.

Accordingly, the discharged area development or DAD images, are preferably developed using the pneumatically coupled sonic toner release development units of the present invention, shown generally as 40, 42 and 44 (to be described in detail below). Although not shown, the development units 40, 42, and 44 are each biased about −100 volts closer to $V_{DAD}$ than $V_{white}$ (therefore at about −400 volts).

Still referring to FIG. 1, a color controller (ESS) 99 and user interface (not shown) provide means for user selection of the final color for the DAD image. The user interface, for example, may comprise a plurality of control knobs, one for each pneumatically coupled sonic toner release development unit. By reference to a color palette, not shown, the user can obtain the settings for the control knobs. For example, once a specific color is identified by the user the setting of these knobs determines the individual biases for the development units. In addition, since the photoreceptor contains both positive and negative toner particles thereon, a pre-transfer corotron 110 is provided for effecting a unipolar toner image charge prior to transfer at a transfer station DD.

After the electrostatic latent image has been subjected to the pre-transfer corotron 110, the photoreceptor belt advances the toner powder images to transfer station DD. A copy sheet 112 is advanced to transfer station DD by sheet feeding apparatus, not shown. Preferably, the sheet feeding apparatus includes a feed roll contacting the uppermost sheet of a stack of sheets. The feed roll rotates to advance the uppermost sheet from stack into chute 114. Chute 114 directs the advancing sheet into contact with photoconductive surface 11 of belt 10 in a timed sequence so that the toner powder images developed thereon contact the advancing sheet at transfer station DD. Transfer station DD includes a corona generating device 116 which sprays ions onto the back side of sheet 112. This attracts the toner powder image from photoconductive surface 11 to sheet 112. After transfer, sheet 112 continues to move in the direction of arrow 118 onto a conveyor (not shown) which advances sheet 112 to fusing station EE.

Fusing station EE includes a fuser assembly, indicated generally by the reference numeral 120, which permanently affixes the transferred powder image to sheet 112. Fuser assembly 120 includes a heated fuser roller 122 and back-up roller 124. Sheet 112 passes between fuser roller 122 and back-up roller 124 with the toner powder image contacting fuser roller 122. In this manner, the toner powder image is directly heated and permanently affixed to sheet 112. After fusing, sheet 112 advances through a chute, not shown, to a catch tray, also not shown, for subsequent removal from the reproduction machine by the operator.

After the copy sheet is separated from photoconductive surface 11 of belt 10, the residual toner particles adhering to photoconductive surface 11 are removed therefrom at cleaning station FF. Cleaning station FF may include a rotatably mounted fibrous brushes 130, 132 in contact with photoconductive surface 11. Subsequent to cleaning, a discharge lamp (not shown) floods the photoreceptor with light to dissipate any residual electrostatic charge remaining thereon prior to the charging thereof for the next successive imaging cycle.

Figure 2:
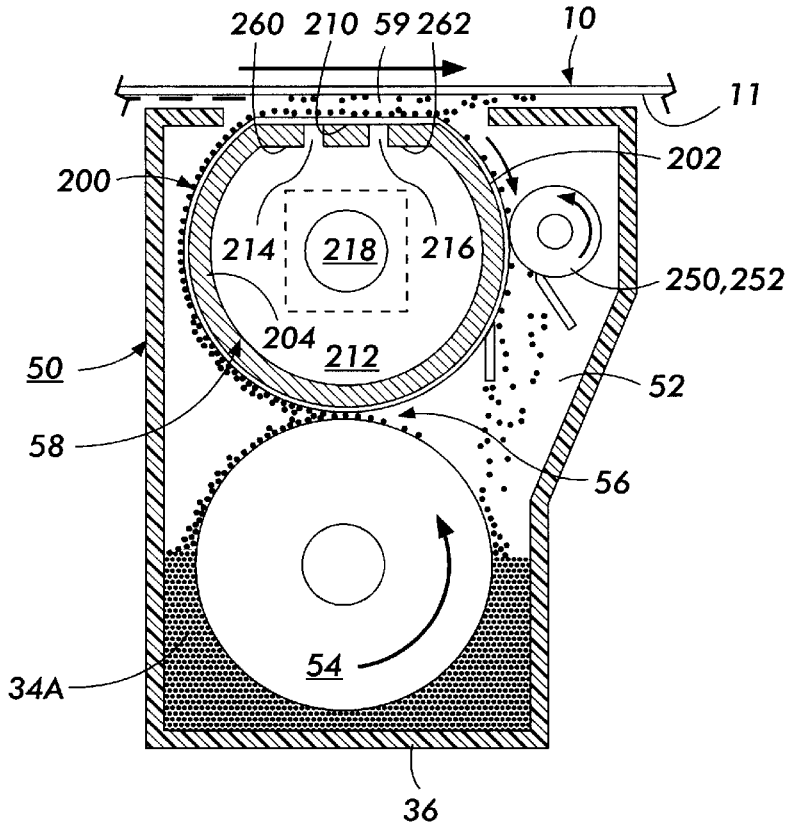
FIG. 2 is an enlarged vertical end illustration of the development apparatus of FIG. 1.
Figure 3:
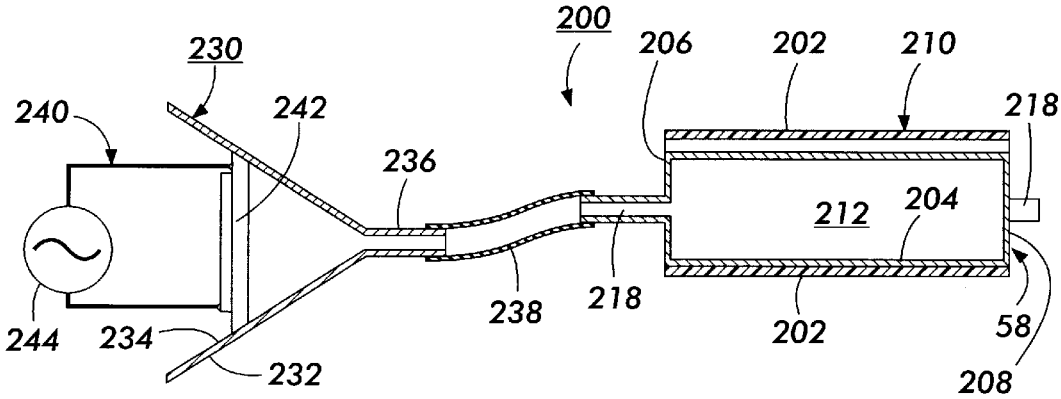
FIG. 3 is a schematic illustration of the pneumatically coupled sonic toner release assembly of the development apparatus in accordance with the present invention.

Referring now to FIGS. 1–3, each of the pneumatically coupled sonic toner release development units 40, 42 and 44 as used in the machine 9 is identical to the others in this group, except for the particular color of toner particles each contains. Therefore, in accordance with the present invention, each of the units 40, 42 and 44 contains and is adapted to selectively and uniformly deposit varying amounts of appropriately charged, color (other than black) toner particles, onto the DAD portion of the tri-level image in a highlight color machine as shown, or onto appropriate color separation images in a full process color machine. For example, these pneumatically coupled sonic toner release development units 40, 42, 44 may contain and selectively deposit negatively charged, magenta, yellow and cyan toners, respectively, on the DAD images.

Referring now in particular to FIG. 2, a representative pneumatically coupled sonic toner release development unit 50 (representing the units 40, 42, 44) of the present invention, advantageously includes pneumatic donor assembly 200 for transporting and releasing charged toner particles within the development nip 59 of the machine 9. The representative unit 50, as shown, includes a development housing 36 defining a sump 52 containing developer material 34A as shown, or 34B, or 34C, of a non-black color, for example magenta, cyan, yellow. The developer material 34A, 34B, 34C is mixed and triboelectrically charged within the sump 52 by mixing augers (not shown), and picked up by a feeder magnetic roll 54. The picked up developer material serves to electrostatically load toner at a nip 56 from the magnetic roll 54 onto the pneumatic donor assembly 200.

As shown, the pneumatic donor assembly 200 includes a support mandrel 58, and a flexible, acoustically deformable sleeve or membrane 202 of the present invention. The mandrel 58, as illustrated, is preferably in the form of a D-shaped roller. As shown, the development unit 50 is mounted within a machine such that the donor assembly 200 forms the development nip (or air gap) 59 with the retentive surface 11 of the latent image bearing member 10, for presenting charged toner particles to latent electrostatic images on the surface for image development.

Referring in particular to FIGS. 2 and 3, the support mandrel 58 is elongate and has a first end 206 and a second end 208. Being a D-shaped roller, the mandrel 58 thus includes an elongate flat portion 210 extending from one end 206, 208 to the other. Importantly, the support mandrel 58 preferably includes a wall 204 defining a closed pneumatic chamber 212, and having a number of slots including slots 214, 216 that are preferably narrow and formed through the wall 204 for communicating between the closed pneumatic chamber 212 and an exterior of the mandrel 58. As shown, the slots 214, 216 are formed extending end to end within the flat portion 210 of the mandrel 58 and define "active" donor areas, that is, areas of toner particle release during operation. The number of slots 214, 216 instead of being formed end to end, can also be formed in a "chevron" (i.e. short slanted) pattern across the flat portion 210. Such a chevron design has been found to reduce nodal effects of both orthogonal to process, and in process direction, acoustic wave propagations.

As shown more clearly in FIG. 3, the closed ends 206, 208 of the mandrel 58 each include a pneumatic port 218 for enabling pneumatic coupling of the closed pneumatic chamber 212 with a pneumatic coupling device 230 to a remote acoustic transducer 240.

The donor sleeve or membrane 202, is preferably seamless and consists, for example, of an aluminized polyester film such as aluminized MYLAR (Trademark of Du Pont) film. The donor sleeve or membrane 202 is mounted slidably over and around the support mandrel 58. As further illustrated, the donor sleeve or membrane 202 is driveable by a suitable device such as drive rolls 250, 252, around the support mandrel 58 for transporting charged toner particles from the sump 52 through the development zone or nip 59 of the reproduction machine 9.

Referring in particular to FIG. 3, the acoustic transducer 240 includes a power supply source 244, and a piezoelectric (PZT) driven brass disc 242, for example, that is connected to the pneumatic coupling device 230 in accordance with the present invention. The pneumatic coupling device 230 preferably includes a funnel member 232 and pneumatic conduit or tubing 238. A large end 234 of the funnel member 232 as shown is connected to the acoustic transducer 240, and the narrow end 236 of the funnel member is attached to a first end of the conduit or tubing 238. The other end of the conduit or tubing is then connected via one of the ports 218 in one of the closed ends 206, 208 of the mandrel, to the closed pneumatic chamber 212 of the pneumatic donor assembly 200.

In experiments verifying the effectiveness of pneumatic coupling of acoustic energy in accordance with the present invention, there were clear indications of effective coupling of acoustic energy through a funnel member such as 232, and tubing such as 238. Visual observations were made of motions induced in toner and carrier particles on the surface of a donor membrane such as 202, when an acoustic transducer including a PZT/brass disc transducer 240 was activated by a power supply source 244 represented by an sinusoidal voltage V=Asinwt. A number of apparent resonant frequencies were also observed in the 20–26 KHz frequency range. Subsequent experiments with a similar apparatus were also used to demonstrate actual toner release (development) from similar pneumatic donor assemblies, and at reduced electric fields due to pneumatic coupling of acoustic motion in accordance with the present invention.

Preferably, the total donor "active" area as represented by the flat portion 210 of the mandrel 58 is kept to a minimum in order to both improve acoustic motion uniformity, and to increase motion amplitudes. Uniformity enhancement is anticipated by virtue of reduced "spans" of the donor sleeve 202 which should reduce the likelihood of multiple mode deformations with their resulting node-antinode patterns of motion.

One of the potential advantages of pneumatic coupling for (STORE) development for multicolor image reproduction is the reduction in both development space and hardware required within the machine. This is because such development can be achieved by using only a single acoustic transducer 240 to provide acoustic energy that is then coupled via a pneumatic coupling device or manifold 230 to multiple donor development stations. Precise control of acoustic motion magnitudes at each individual development unit can be achieved by valving.

Although the foregoing description has focused primarily on the application of pneumatic coupling to a (STORE) development process, it should be understood that pneumatic coupling as such is also equally an option for other process steps. Such process steps could include for example Acoustic Transfer Assist (ATA) development, Acoustic Cleaning Assist (ACA), and even (ADA) Acoustic Development Assist development.

As further shown in the FIG. 2 the pneumatic donor assembly 200 includes damping lips 260, 262 for sealing the closed pneumatic chamber 212 and for limiting propagation of acoustic energy out of the desired area of activation. The damping lips 260, 262 could have a low friction coating on their exterior surfaces to reduce drag on the sleeve or membrane 202. It is believed to be advantageous to also offset acoustically modulated air pressure within the closed pneumatic chamber 212 with a negative pressure (i.e., vacuum not shown) in order to assure proper sealing of the chamber by the sleeve or membrane 202 against the mandrel 58.

In summary, the purpose of this proposal is to suggest pneumatic coupling as an alternative to mechanical coupling of acoustic energy in a (STORE) development subsystem. Advantages include improved uniformity of acoustic energy coupling, and decreased development space requirements and costs within a reproduction machine.

It has been found that pneumatic coupling of acoustic energy to a Sonic Toner Release (STORE) donor assembly offers an alternative means for producing development donor motions as well as has several advantages. Pneumatic coupling as such produces uniformity of acoustic motions, and clearly appears to provide a means for reducing the size/process space ordinarily required within a multicolor reproduction for (STORE) development. For example, such reduction can be achieved by pneumatically coupling a single acoustic energy transducer in accordance with the present invention, to a plurality of individual color development units within the machine. Such reduction is an important attribute for single pass multi-color reproduction machines.

As can be seen, there has been provided a multicolor reproduction machine, and an advantageous pneumatically coupled sonic toner release development unit according to the present invention. The pneumatically coupled sonic toner release development apparatus is provided for reliably and uniformly developing latent electrostatic images in a toner image reproduction machine using charged toner particles. The pneumatically coupled sonic toner release development apparatus includes a development housing defining a sump for holding developer material containing the charged toner particles; a developer material moving device mounted within the sump for transporting developer material within the sump; and a pneumatically coupled sonic toner release assembly including an acoustic transducer, a pneumatic coupling device connected to the acoustic transducer, and a pneumatic donor assembly connected to the pneumatic coupling device. The pneumatic donor assembly is mounted partially within the sump for receiving charged toner particles from the developer material moving device and for transporting the charged toner particles through a development nip of a reproduction machine for high quality image development. The acoustic transducer and pneumatic coupling device produce uniform acoustic motions in the pneumatic donor assembly for uniformly releasing charged toner particles from the pneumatic donor assembly, thereby resulting in high quality toner image development.

While the present invention has been described with reference to a preferred embodiment, it will be appreciated from this teaching that within the spirit of the present invention, various alternative modifications, variations or improvements therein may be made by those skilled in the art.

What is claimed is:

1. A pneumatically coupled sonic toner release development apparatus for reliably and uniformly developing latent electrostatic images in a toner image reproduction machine using charged toner particles, the pneumatically coupled sonic toner release development apparatus comprising:

(a) a development housing defining a sump for holding developer material containing the charged toner particles;

(b) developer material moving device mounted within said sump for transporting developer material within said sump; and (c) a pneumatically coupled sonic toner release assembly including an acoustic transducer, a pneumatic coupling device connected to said acoustic transducer, and a pneumatic donor assembly connected to said pneumatic coupling device, said pneumatic donor assembly being mounted partially within said sump for receiving charged toner particles from said developer material moving device and for transporting the charged toner particles through a development nip of a reproduction machine for high quality image development, and said acoustic transducer and pneumatic coupling device producing uniform acoustic motions in said pneumatic donor assembly for uniformly releasing charged toner particles from said pneumatic donor assembly, thereby resulting in relatively high quality toner image development.

2. The pneumatically coupled sonic toner release development apparatus of claim 1, wherein said pneumatic donor assembly includes a mandrel having a wall defining a pneumatic chamber and a number of slots into said pneumatic chamber, and a flexible sleeve mounted over said mandrel and said slots for generating acoustic deformations.

3. The pneumatically coupled sonic toner release development apparatus of claim 1, wherein said acoustic transducer includes a power source and a piezoelectric element.

4. The pneumatically coupled sonic toner release development apparatus of claim 1, wherein said pneumatic coupling device includes a funnel member connected to said acoustic transducer, and a pneumatic conduit connected to said pneumatic donor assembly.

5. The pneumatically coupled sonic toner release development apparatus of claim 2, wherein said mandrel comprises a D-shaped roller including a flat portion extending from one end to another.

6. The pneumatically coupled sonic toner release development apparatus of claim 3, wherein said piezoelectric element is a brass disc.

7. The pneumatically coupled sonic toner release development apparatus of claim 5, wherein said number of slots are formed through said wall within said flat portion.

8. A pneumatically coupled sonic toner release development apparatus for developing latent electrostatic images in a toner image reproduction machine using charged toner particles, the pneumatically coupled sonic toner release development apparatus including:

(a) a development housing defining a sump for holding developer material containing charged toner particles;

(b) a developer material moving device mounted within said sump for transporting developer material within said sump; and (c) a pneumatic donor assembly mounted partially within said sump for receiving toner particles from said developer material moving device and for transporting the charged toner particles through a development nip of a reproduction machine, said pneumatic donor assembly including a stationary mandrel and a flexible membrane mounted slidably over said mandrel for producing uniform acoustic motions suitable for releasing in charged toner particles on said membrane, thereby resulting in uniform and relatively higher quality toner image development in a reproduction machine.

9. The pneumatically coupled sonic toner release development apparatus of claim 8, wherein said flexible sleeve comprises an aluminized polyester film.

10. The pneumatically coupled sonic toner release development apparatus of claim 8, wherein said mandrel includes a wall defining a pneumatic chamber and slots through said wall into said pneumatic chamber.

11. An electrostatographic reproduction machine for creating relatively high quality toner images, the electrostatographic reproduction machine comprising:

(a) a movable image bearing member supported for movement along an endless path;

(b) means for forming latent electrostatic images on said image bearing member; and (c) a pneumatically coupled sonic toner release development apparatus for developing the latent electrostatic images using charged toner particles, said pneumatically coupled sonic toner release development apparatus including:

(i) a development housing defining a sump for holding developer material containing charged toner particles;

(ii) a developer material moving device mounted within said sump for transporting developer material within said sump; and (iii) a pneumatically coupled sonic toner release assembly including an acoustic transducer, a pneumatic coupling device connected to said acoustic transducer, and a pneumatic donor assembly connected to said pneumatic coupling device, said pneumatic donor assembly being mounted partially within said sump for receiving charged toner particles from said developer material moving device and for transporting the charged toner particles through a development nip of a reproduction machine for high quality image development, and said acoustic transducer and pneumatic coupling device producing uniform acoustic motions in said pneumatic donor assembly for uniformly releasing charged toner particles from said pneumatic donor assembly, thereby resulting in relatively high quality toner image development.

* * * * *